US006144005A

United States Patent [19]

Tanimizu et al.

[11] Patent Number: 6,144,005

[45] **Date of Patent: *Nov. 7, 2000**

[54] VACUUM SWITCH AND A VACUUM SWITCHGEAR USING THE SAME

[75] Inventors: Toru Tanimizu; Masato Kobayashi; Shuichi Kikukawa; Ayumu Morita; Minoru Suzuki; Yoshimi Hakamata; Katsunori Kojima; Yozo Shibata; Yoshitomo Gotoh; Makoto Terai; Takuya Okada; Naoki Nakatsugawa, all of Hitachi, Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/114,944

[22] Filed: Jul. 14, 1998

[30] Foreign Application Priority Data

| | | | |
|---|---|---|---|
| Jul. 23, 1997 | [JP] | Japan | 9-196756 |
| Jul. 23, 1997 | [JP] | Japan | 9-196757 |
| Jul. 23, 1997 | [JP] | Japan | 9-196758 |
| Sep. 8, 1997 | [JP] | Japan | 9-242390 |
| Sep. 8, 1997 | [JP] | Japan | 9-242391 |
| Sep. 8, 1997 | [JP] | Japan | 9-242392 |
| Sep. 8, 1997 | [JP] | Japan | 9-242393 |
| Oct. 3, 1997 | [JP] | Japan | 9-270827 |
| Oct. 3, 1997 | [JP] | Japan | 9-270828 |
| Oct. 3, 1997 | [JP] | Japan | 9-270830 |

[51] Int. Cl.[7] ..... H01H 33/66

[52] U.S. Cl. ..... 218/118; 218/139; 218/155

[58] Field of Search ..... 218/118, 120, 218/121, 122, 123, 124, 125, 134, 139, 140, 153, 154, 155, 152, 119

[56] References Cited

U.S. PATENT DOCUMENTS

| | | | |
|---|---|---|---|
| 1,835,596 | 12/1931 | Hellmund et al. . | |
| 3,571,543 | 3/1971 | Perkins et al. | 218/154 |
| 3,845,263 | 10/1974 | Dickinson . | |
| 4,107,496 | 8/1978 | Clason | 218/154 |
| 4,250,535 | 2/1981 | Adolph et al. | 361/335 |
| 4,445,162 | 4/1984 | Hamm et al. . | |
| 5,387,772 | 2/1995 | Bestel . | |
| 5,436,414 | 7/1995 | Hodkin et al. | 218/84 |
| 5,719,365 | 2/1998 | Tanimizu et al. . | |
| 5,736,704 | 4/1998 | Asselin et al. | 218/68 |

FOREIGN PATENT DOCUMENTS

| | | |
|---|---|---|
| 0766277 | 4/1997 | European Pat. Off. . |
| 2204867 | 5/1974 | France . |
| 2211736 | 7/1974 | France . |
| 1909642 | 2/1970 | Germany . |
| 2742775 | 3/1979 | Germany . |
| 55-75527 | 6/1980 | Japan . |
| 55-143727 | 11/1980 | Japan . |
| 56-69734 | 6/1981 | Japan . |
| 57-17528 | 1/1982 | Japan . |
| 57-17529 | 1/1982 | Japan . |
| 57-196421 | 12/1982 | Japan . |
| 3-273804 | 12/1991 | Japan . |
| 357771 | 1/1973 | U.S.S.R. . |
| 1765853 | 9/1993 | U.S.S.R. . |
| 451963 | 2/1935 | United Kingdom . |
| 1329725 | 9/1973 | United Kingdom . |

OTHER PUBLICATIONS

K.I. Doroshev, "Exploration of Switchgear Units of 6–220 kV", pp. 133–134 and Figure 3.35., (No Date).

European Search Report dated Mar. 19, 1999.

*Primary Examiner*—Lincoln Donovan
*Attorney, Agent, or Firm*—Beall Law Offices

[57] ABSTRACT

A vacuum insulation switch provided with a movable electrode, a stationary electrode and an earthing electrode, which are insulated from each other, in a vacuum container made of a conductive material which is earthed, and a switchgear using the same.

33 Claims, 8 Drawing Sheets

VACUUM SWITCH AND A VACUUM SWITCHGEAR USING THE SAME

BACKGROUND OF THE INVENTION (1) Field of the Invention

The present invention relates to a vacuum switch and a vacuum switchgear, and especially to a vacuum switch with an electrically conductive vacuum container which is grounded or earthed and a vacuum switchgear using the same.

(2) Description of the Prior Art

Electric power demand in a central area of a large city increases day by day. On the other hand, there are problems such as difficulty in providing locations for distribution substations, difficulty in laying pipes for distribution lines underground and so on. Further, it is required that a substation is operated at the high availability factor.

To solve those problems, a distribution voltage has been raised, and increasing power demand is distributed to power lines with the larger capacity. Thereby, effective power supply installations can be realized. To this end, it is required to make devices for distribution and substation more compact.

As an example of compact substation devices, a $SF_6$ gas insulation switchgear as disclosed in JP-A-3-273804 is proposed. According thereto, a circuit breaker, two sets of disconnectors and an earthing or grounded switch are manufactured independently, and therefore, they are accommodated in a unit room and a bus bar room filled with insulation gas such as $SF_6$ gas. In a case where a vacuum circuit breaker is used as a circuit breaker, a movable electrode is moved by an operating mechanism up and down with respect to a stationary electrode, whereby a circuit is opened and closed. Further, in a vacuum circuit breaker as described in JP-A-55-143727, a rotatable electrode turns clockwise or counterclockwise, whereby a circuit is opened and closed.

A substation receives electric power from a power plant through a disconnector and a gas circuit breaker, changes the voltage thereof by a transformer to a voltage suitable for a load, and supplies the electric power to the load such as an electric motor. When devices in such a substation are inspected and/or maintained, power is cut by a gas circuit breaker and then a circuit is opened by a disconnector. After that, an earthing switch is operated to discharge any electric charge having remained in a bus bar to flow induction current to the earth, and the re-application of voltage by the source is prevented to thereby secure the safety of a worker.

Further, if a bus bar with a charge is or grounded before discharging, an accident may easily occur. Therefore, an interlock between an earthing switch and a disconnector is necessary to be provided.

The $SF_6$ gas insulated switchgear disclosed in JP-A-3-273804 accommodates its gas circuit breaker, two disconnectors and the earthing switch in its unit room and bus bar room filled with $SF_6$ gas as installed in its distribution cubicle. In the case where a vacuum circuit breaker is used as its circuit breaker, the movable electrode is moved vertically from its stationary electrode by means of an actuator of the vacuum circuit breaker thereby opening and closing the circuit. In the vacuum circuit breaker disclosed in JP-A-55-143727, a movable lead wire corresponding to a movable blade and a movable electrode are caused to swivel around a pivotal point of its main axis so as to contact with or separate from its stationary electrode, thereby closing or opening the circuit.

Furthermore, a conventional vacuum container has been made of insulator material, and therefore the container could not be earthed.

SUMMARY OF THE INVENTION

An object of the present invention is to provide a vacuum switch and a vacuum switchgear, which is drastically miniaturized.

Another object of the present invention is to provide a vacuum switchgear which does not use insulation gas, such as $SF_6$, which is harmful to the environment.

A feature of the present invention resides in a vacuum insulation switch comprising a conductive vacuum container which is earthed or grounded and hermetically seals the following elements therein: a stationary electrode arranged within the vacuum container through an insulator, a movable electrode arranged within the vacuum container through an insulator so as to be capable of contacting with and separating from the stationary electrode, and an operating mechanism for operating the movable electrode through an operating mechanism.

A further feature of the present invention resides in a vacuum insulation switchgear including the vacuum switch as mentioned above and a controller for controlling the same.

In the present invention, a switch refers to a device which has a movable electrode and a stationary electrode and carries out the switching operation thereof, and a switchgear refers to a device, including a control device, in which at least one switching device and at least one device selected from among devices for manipulation, measurement, protection and adjustment are accommodated in a closed container. Further, the switchgear may include an assembly including accessories and a supporting structure.

BRIEF DESCRIPTION OF THE DRAWINGS

FIGS. 6 and 7 are drawings for explaining the movement of the movable electrode in the switching operation of the vacuum switchgear as shown in FIG. 3, in which FIG. 7 shows the situation that the switchgear is closed and FIG. 6 the situation that the switchgear is earthing;

FIGS. 8 and 9 are drawings for explaining the operation of a vacuum switchgear according to another embodiment of the present invention, wherein FIG. 8 shows the situation that the movable electrode of the switchgear is closed and FIG. 9 the situation that a movable electrode of an earthing electrode of the switchgear is earthing;

DESCRIPTION OF THE PREFERRED EMBODIMENTS

Figure 1:
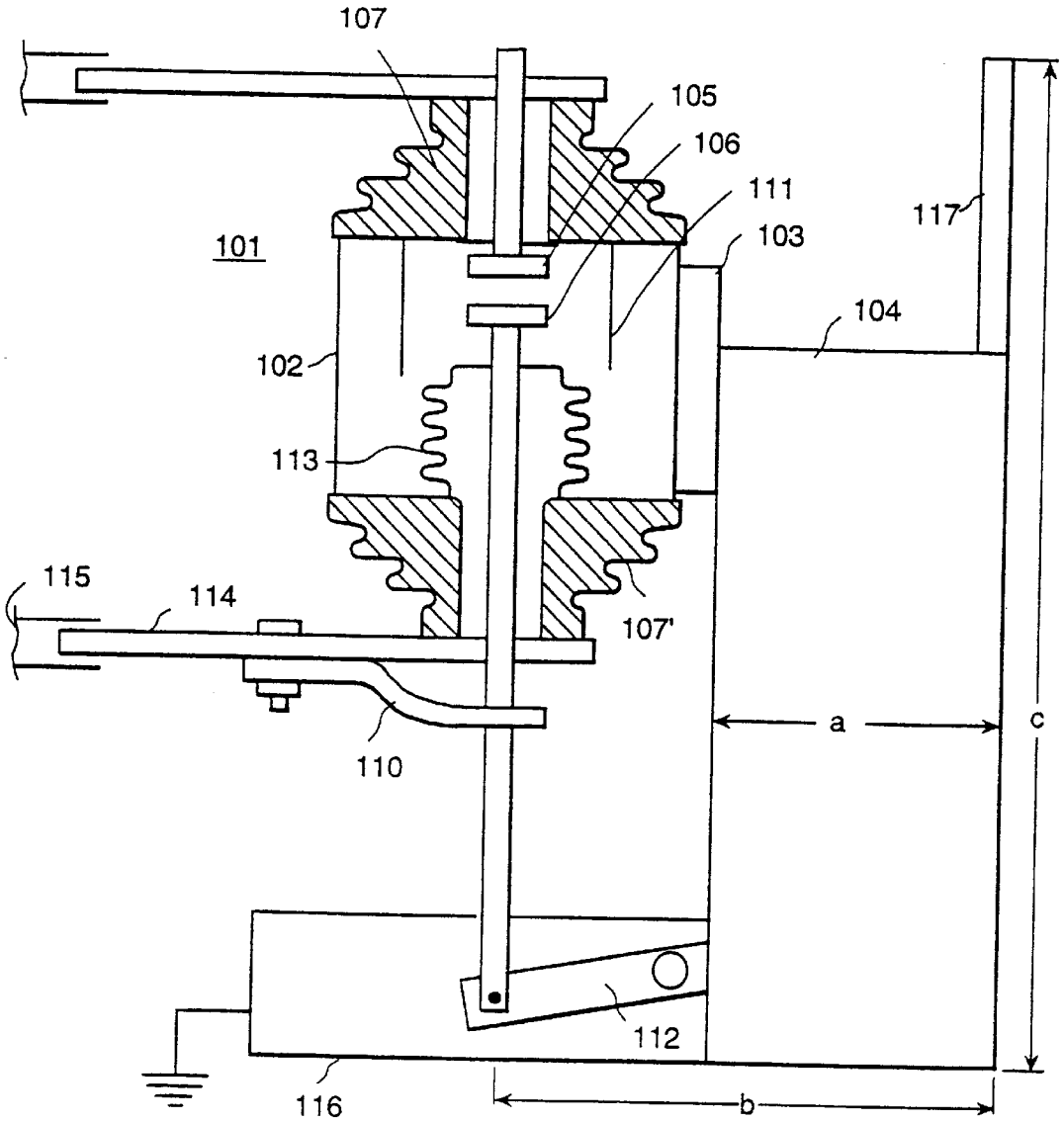
FIG. 1 is a sectional side view showing an embodiment of a basic construction of a vacuum switchgear of the present invention.

Referring at first to FIG. 1, description will be done of the basic construction of a vacuum insulation switchgear according to the present invention.

As shown in the figure, vacuum container 101 has a container composed of cylindrical part 102 made of conductive material, such as stainless steel. Upper and lower insulators 107, 107' are connected to the cylindrical part 102 in an airtight state (the thus constructed container as a whole will be referred to as "vacuum container (or simply, container) 101" hereinafter).

The container 101 is attached to operating compartment 104 through conductive attachment 103, whereby the cylindrical part 102 is earthed or grounded through conductive boxes of compartment 104 and support 116. In the upper portion of compartment 104, there is provided a protection plate 117 for protection of the vacuum switch. Further, on the bottom of operating compartment 104 and support plate 116, there are provided wheels (not shown) so as to allow transport thereof. The vacuum container 101 accommodates therein stationary electrode 105 and movable electrode 106. The stationary electrode 105 is fixedly supported by the insulator 107. The movable electrode 106 is supported by the insulator 107' through bellows 113, whereby the electrode 106 can be moved up and down by operating rod 112. Further, the movable electrode 106 is electrically coupled with external circuit 115 by flexible conductor 110 through conductor 114.

Arc shield 111 is disposed to surround the electrodes 105 and 106 so that an earthing accident caused by contacting of an arc at the time of interruption with the vacuum container 102 is prevented.

The movable electrode 106 and the stationary one 105 are hermetically put in vacuum. As vacuum is a good insulator, the distance between the electrodes and the components can be made considerably small, with the result that the vacuum switch 101 becomes small in size. Since a vacuum switch has a hermetically sealed structure, the number of constituent parts thereof is decreased as a whole. Therefore, the manufacturing cost of the vacuum switchgear can be reduced, and the probability of occurrence of fault or trouble can also be lowered as well.

In FIG. 1, since the vacuum container 101 is earthed and the insulators 107, 107' are provided, the depth a of operating compartment 104 can be made smaller compared with that in a conventional vacuum container. As a result, the depth b of the switchgear as a whole can be made small.

Figure 2:
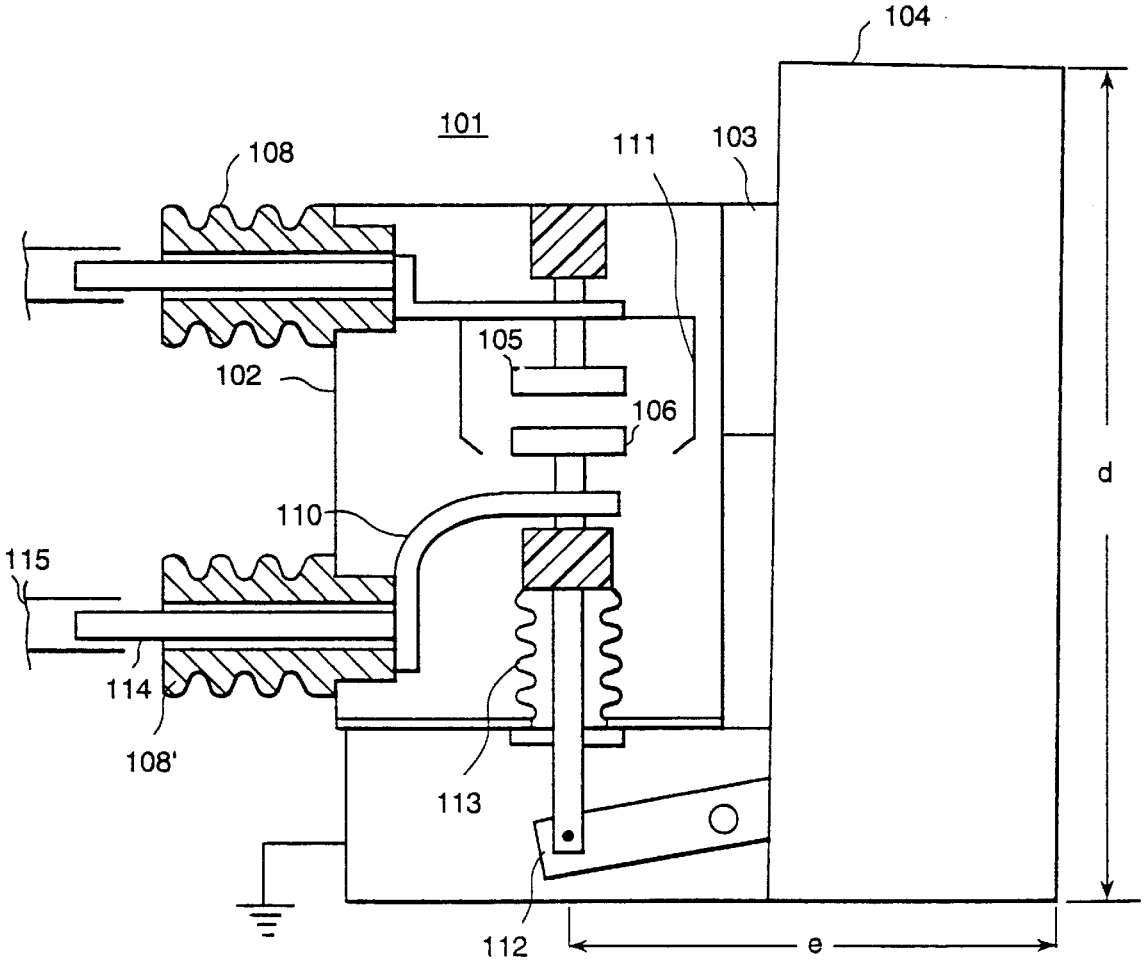
FIG. 2 is a sectional side view showing another embodiment of a basic construction of a vacuum switchgear of the present invention.

FIG. 2 shows another example of the basic construction of a vacuum switchgear according to the present invention. In the figure, the same reference numerals denote the same parts as in FIG. 1. In this example, insulators 108, 108' are attached to the vacuum container 102 such that a part of the insulators 108, 108' are positioned within the container 102. With this structure, since the distance between the vacuum switch and the operating mechanism can be shortened, the dimensions of the operating compartment, for example, its height d (where d<c) and of the switchgear, for example, its depth e can be reduced, thereby substantially reducing the volume and dimensions of the switchgear.

In the following, description will be made of the concrete structural arrangement and the operation of a vacuum switchgear according to an embodiment of the present invention, referring to FIG. 3 and the following.

Generally, a switch box is constructed with plural switches or switchgears, the operating mechanism thereof and other necessary constituent parts, which are accommodated in a cubicle. In FIG. 3, reference numeral 16 denotes such a cubicle. The cubicle 16 is provided with two doors 19, 19' on the front side (left in the drawing), for assembly, inspection and maintenance of the switch box. In the cubicle 16, there are arranged a vacuum switch 1 and two compartments 17 and 18.

The vacuum switch 1 according to the present invention has the integrated functions of circuit breaking, circuit disconnecting and earthing and is mainly composed of vacuum container 4 made of stainless steel, for example, stationary electrode 5, movable electrode 7 and earthing electrode 39 as well as internal bus bars 8 for U, V, W phases. For every one of the U, V, W phases, a set of the stationary electrode 5, the movable electrode 7 and the earthing electrode 39 are provided.

If the movable electrode 7 moves to come into contact with the stationary electrode 5, the internal bus bar 8 associated with the stationary electrode 5 is electrically coupled with an external circuit through load-side lead or conducter 9 and cable head 10 attached thereto. If the movable electrode 7 comes into contact with the earthing electrode 39, conductor 9 is grounded. Further details of the structure of the vacuum switch 1 will be explained later, together with the description of the operation thereof.

The compartment 17 accommodates the mechanism for operating the vacuum switch 1 and, therefore, will be called an operating compartment, hereinafter. Further, it is convenient, if the operating compartment 17 is provided with a room or space therein for keeping tools for inspection and maintenance. The compartment 18 accommodates the cable head 10 for electrically coupling the vacuum switch 1 with an associated cable and, therefore, will be called a cable compartment, hereinafter. Further, current transformer 13 can be attached to a cable in the cable compartment 18, if necessary.

In the embodiment as shown, the two compartments 17 and 18 are arranged diagonally with respect to the vacuum switch 1 in such a manner that the cable compartment 18 is positioned on the front side, compared with the operating compartment 17. This arrangement enables easily and safely performing the work for attaching and maintaining the cable heads 10 and the cables to be coupled therewith.

Figure 3:
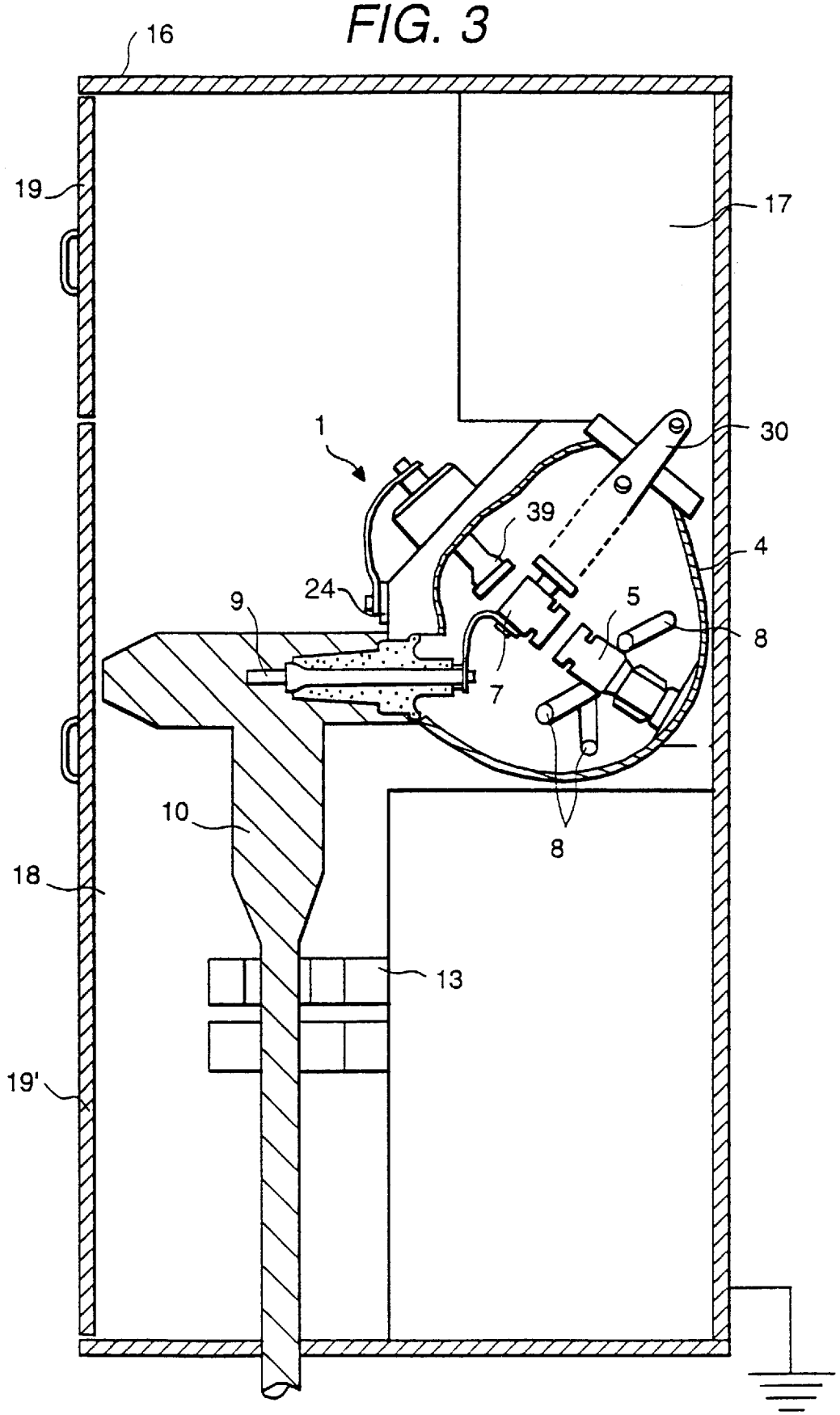
FIG. 3 is a sectional side view schematically showing another embodiment of a vacuum switchgear of the present invention.
Figure 4:
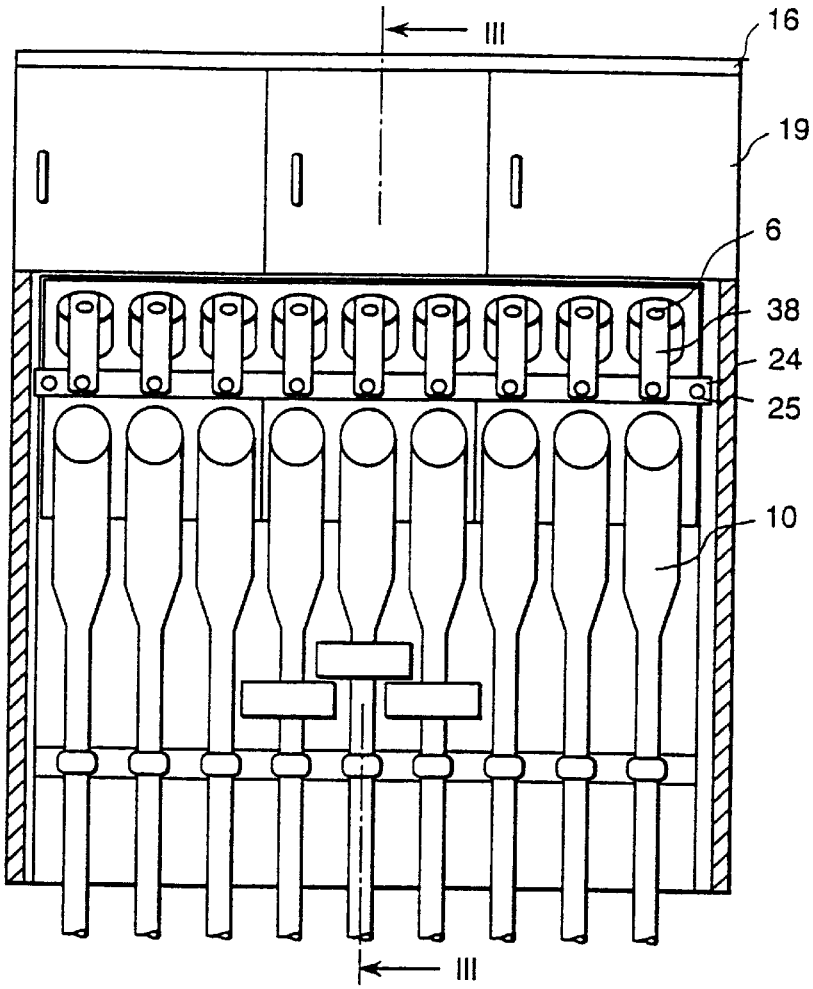
FIG. 4 is a front view of the vacuum switchgear as shown in FIG. 3 viewed from left in the drawing, wherein lower doors of a switchgear cubicle are removed.

When the cubicle 16 as shown in FIG. 3 is viewed from the left in the figure, the inside thereof reveals what is shown in FIG. 4, in which, however, the upper doors 19 are closed and the lower ones 19' are removed for the convenience of explanation. FIG. 3 as explained above shows the sectional view of the cubicle 16 sectioned along the line III—III in FIG. 4. This figure shows an example of the cubicle 16 which is used for three sets of the three phase circuits, and therefore accommodates nine sets of vacuum switchgears and constituent members associated therewith.

Figure 5:
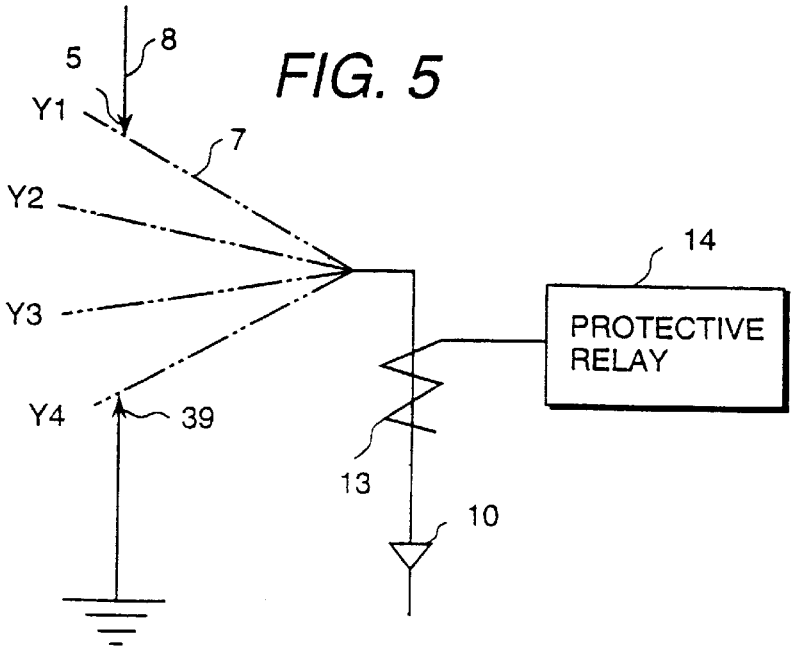
FIG. 5 is a drawing for explaining operating positions of a movable electrode in the switching operation of the vacuum switchgear as shown in FIG. 3.

Referring next to FIG. 5, description will be made of the operational principle of the vacuum switch 1, especially of the positional relationship of the movable electrode 7 relative to the stationary electrode 5 and the earthing electrode 39.

As a halt position of the movable electrode 7, there are defined four positions Y1, Y2, Y3 and Y4, as shown in FIG. 5, in its stepwise or sequential movement of the movable electrode 7 from the stationary electrode 5 to the earthing electrode 39. At the position Y1, the movable electrode 7 comes into contact with the stationary electrode 5, whereby current flows through both the electrodes.

If the movable electrode 7 begins to rotate, it is detached from the stationary electrode 5 (position Y1) to cut off the current, and if the movable electrode 7 continues to rotate, it reaches the position Y2 to stop thereat. The movable electrode 7 stays at this position, until an arc caused by the separation of the electrodes 5, 7 disappears. Its hold time corresponds to one cycle from the occurrence of the arc to extinction thereof.

The movable electrode 7 begins to rotate again and further goes away from the stationary electrode 5 to stop when it reaches the position Y3. The position Y3 is so determined that a dielectric breakdown never occurs in the gap between both the electrodes 7, 5, even if the gap is struck by the lightning. Further, if the movable electrode 7 is at the position Y3, the insulation distance can be secured, which is sufficient enough to prevent a worker from getting an electric shock.

Further, the movable electrode 7 staying at position Y2 or Y3 moves toward disconnecting position Y3 or earthing position Y4, by a driving force from the driving mechanism. In this manner, the movable electrode 7 rotates clockwise to come into contact with the earthing electrode 39 at the earthing position Y4.

The movable electrode 7 can also assume the positions in the reverse order, i.e., in the order of Y3, Y2 and Y1, by applying such an instruction to the driving mechanism. Further, the movable electrode 7 can be shifted from the circuit breaking position Y2 directly to the earthing position Y4, omitting the circuit disconnecting position Y3.

As described above, the movable electrode 7, the stationary electrode 5 and the earthing electrode 39 are constructed such that all of them are put in vacuum which has an extremely high dielectric breakdown voltage, and that the movable electrode 7 can assume four positions successively during one cycle of the operation between the stationary electrode 5 and the earthing electrode 39. Accordingly, a single vacuum switch can have more than one function (circuit breaking, circuit disconnecting, earthing).

Conventionally, those functions had to be achieved by respective components prepared particularly for that purpose, whereas, according to the present invention, a single vacuum switchgear can attain such plural functions. Therefore, the number of constituent parts can be reduced.

Since the movable electrode 7, the stationary electrode 5 and the earthing electrode 39 are integrated as one unit, a vacuum switch according to the present invention can be made substantially smaller in size, compared with a conventional one.

Further, the advantageous effect of providing the disconnecting position Y3 is as follows. Consider the following assumption; i.e., the cubicle as shown in FIG. 4 has a first set (left-hand end in the figure, for example) of the three phase circuit coupled with a power source, a second set (middle in the figure) of the three phase circuit coupled with another power source and a third set (right-hand end in the figure) of the three phase circuit coupled with a load. Further, in a butt joining of different power systems, it is assumed that the movable electrode 7 in the first circuit is at the contact-making position Y1 and therefore the circuit is active, however the movable electrode 7 in the second circuit is at the disconnecting position Y3 and therefore the circuit is in the waiting status. In such situation, the safety can be secured, even if a worker carelessly touches the load-side conductor of the second circuit.

Furthermore, since the switchover operation of the movable electrode 7 from the waiting position Y3 to the making position Y1 and vice versa can be done continuously, the manipulation is speedy and easy. Further, a mechanism, called an interlock, for preventing malfunction can be omitted. If a current transformer 13 is used to detect current and protective relay 14 (see FIG. 5) is operated to thereby trip the manipulation mechanism (not shown), a circuit can be protected from fault or trouble.

In the following, description will be made of a concrete structure of the vacuum switchgear according to an embodiment of the present invention and the operation thereof, referring to FIGS. 6 and 7.

As shown in the figures, the movable electrode 7 is positioned between the stationary electrode 5 and the earthing electrode 39 and has the contact surfaces on both sides thereof, which come into contact with the stationary electrode 5 and the earthing electrode 39, respectively. Further, the movable electrode 7 is attached to movable blade 30 through insulating support members 44, 45, 46 (details of which are omitted).

The movable blade 30 is enveloped by elastic bellows 48 and extends from the inside of the vacuum container 4 to the outside thereof. The movable blade 30 is rotated by a driving mechanism accommodated in the operating compartment 17, with support axis 49 as a rotational center.

Figure 6:
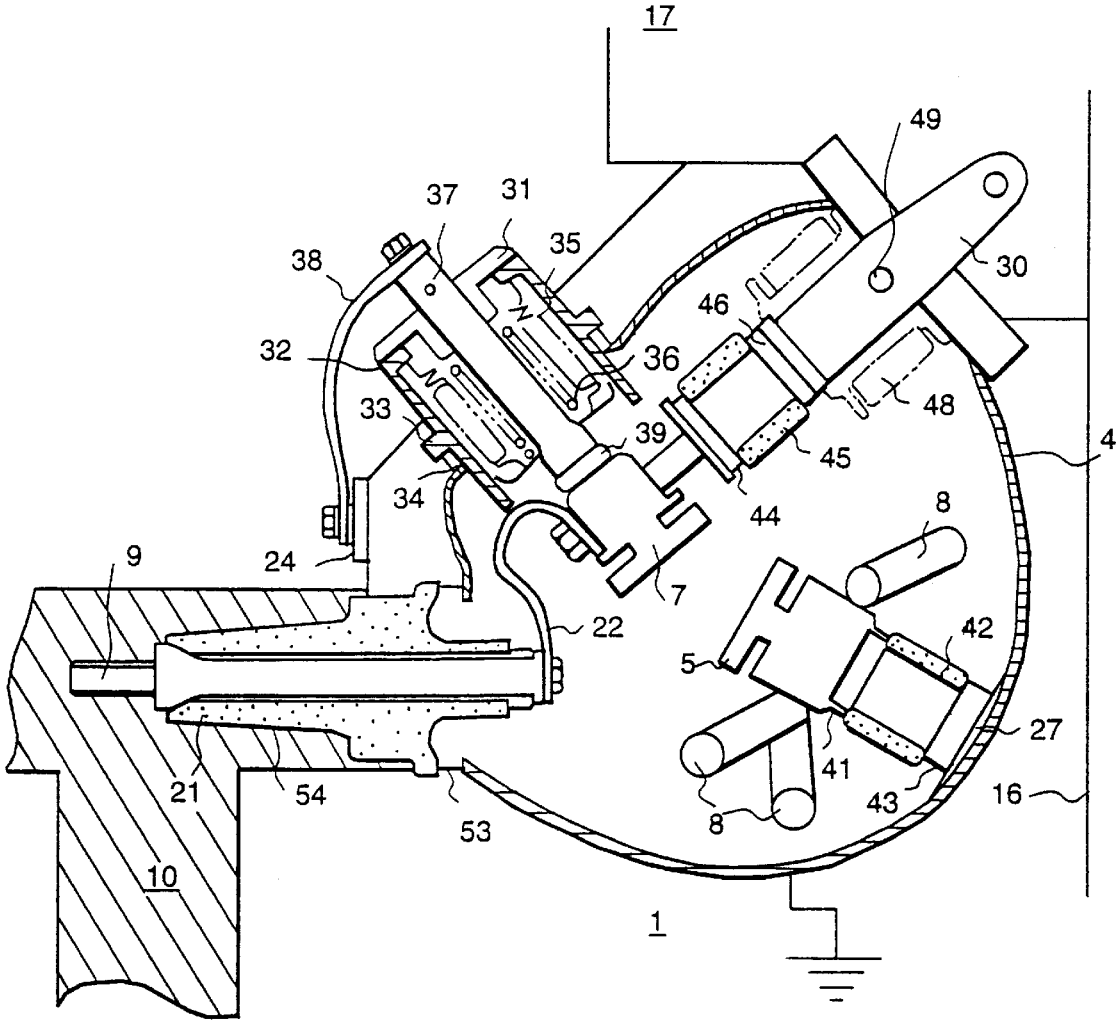

FIG. 6 shows the status that the movable blade 30 has rotated clockwise and therefore the movable electrode 7 is in contact with the earthing electrode 39. Since the movable electrode 7 is electrically coupled with the load-side conductor 9 by means of flexible conductor 22, the cable head 10 is earthed through the conductors 9, 22, the earthing electrode 39, flexible conductor 38 and common earthing conductor 24.

Figure 7:
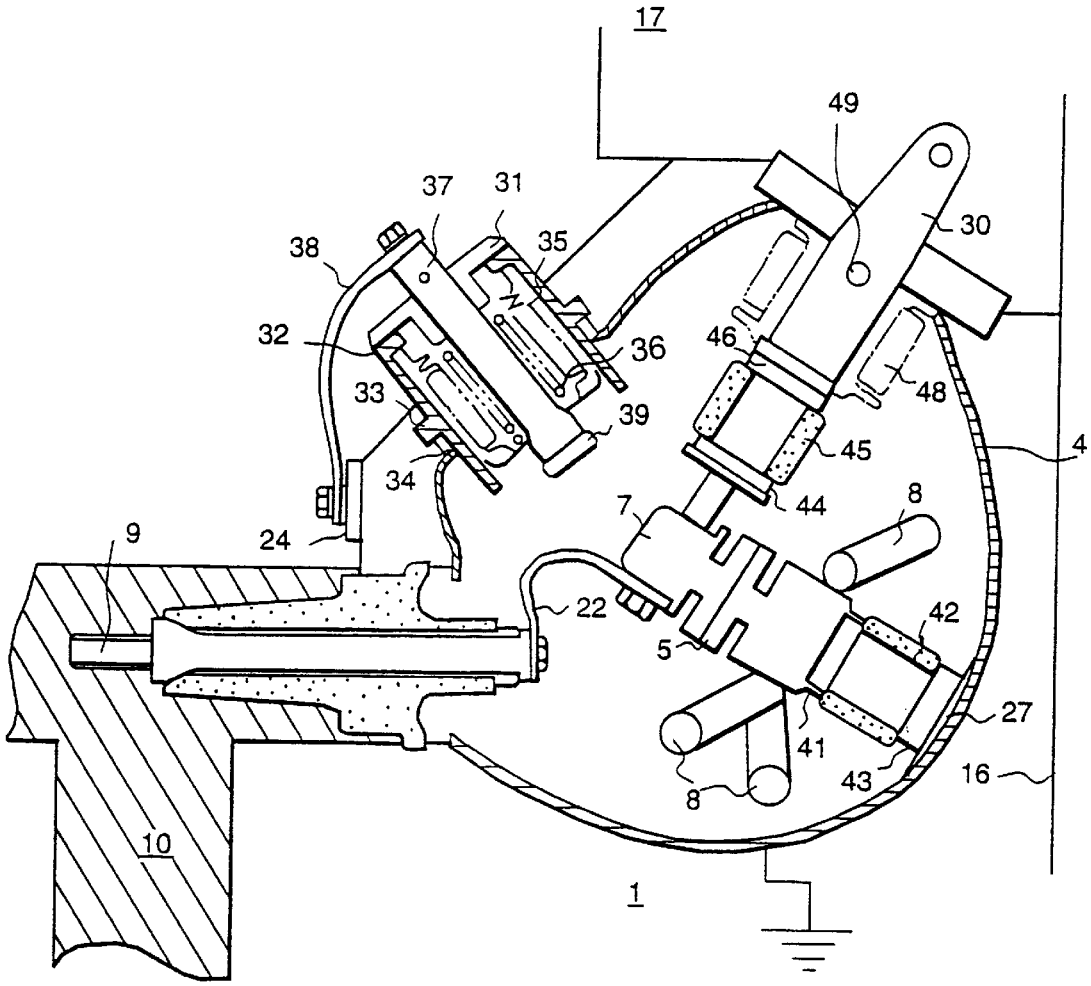

FIG. 7 shows the status that the movable blade 30 has rotated counterclockwise and therefore the movable electrode 7 is in contact with the stationary electrode 5. As a result, the associated internal bus bar 8 is electrically coupled with the cable head 10 through the stationary electrode 5, the movable electrode 7 and the conductors 22, 9.

As a flexible conductor, bundled wire conductors, woven wire conductors or laminated thin conductors can be used. Laminated copper thin plates are preferable, since it is effective to prevent intermetallic sticking in vacuum.

The insulating support members 44, 45, 46 made of ceramics, for example, are provided in order to prevent current from flowing from the movable electrode 7 to the operating mechanism, whereby heat generation can be suppressed. Any insulating material, which has a sufficient heat resistance against a high temperature during manufacture of a vacuum container, can be used for the insulating supporting member.

An earthing device is constructed as follows. Earthing conductor 37 is supported in a slidable manner by a cylindrical member provided on metallic earthing end plate 31. The earthing end plate 31 is attached to bushing 32 made of ceramics, on the outer periphery of which flange 33 is provided. By sealing metal 34 attached to the flange 33, the bushing 32 is fixed to the vacuum container 4.

Within the ceramic bushing 32, there are installed elastic bellows 35 and spring 36 so as to encircle the earthing conductor 37. One end of the earthing conductor 37, which extends outside the vacuum container 4, is coupled with the common earthing conductor 24 through flexible conductor 38. On the opposite end of the earthing conductor 37, there is installed the earthing electrode 39.

When the earthing electrode 39 is pushed toward the end plate 31, the bellows 35 and the spring 36 are pressed and creates a repulsive force, whereby the earthing electrode 39 is pressed against the movable electrode 7.

Preferably, the contacting surfaces of the stationary electrode 5 and the earthing electrode 39 have an angle of inclination so that both surfaces can contact each other uniformly over the whole surfaces. With this, the gap between the stationary electrode 5 and the earthing electrode 39 can be made small and therefore the vacuum container 4 can be made small in size.

The stationary electrode 5 is supported by stationary insulator 42 made of ceramics through metallic junction fittings 41. The insulator 42 is supported by metallic supporting attachment 43, which is soldered to the vacuum container 4. Both the junction fittings 41 and the supporting attachment 43 are attached to both ends of the insulator 42 in advance. Junction terminal board 27 is mounted on an internal wall of vacuum containier 4, which is then connected to the supporting attachment 43.

In FIG. 6, the position, at which the movable electrode 7 is in contact with the earthing electrode 39, corresponds to the earthing position Y4 as shown in FIG. 5, in which the earthing electrode 39 always pushes the movable electrode 7 by the spring 36. In FIG. 7, the position, at which the movable electrode 7 is in contact with the stationary electrode 5, corresponds to the contact-making position Y1 as shown in FIG. 5.

At the contact-making position Y1, the pertinent internal bus bar 8 is electrically coupled with the load-side conductor 9, since both the electrodes 5, 7 are in contact with each other. Accordingly, current flows from the internal bus bar 8 to the load-side conductor 9 through both the electrodes 5, 7 and the flexible conductor 22, not through the movable blade 30 as in the conventional switch. Therefore, the length of current path can be shortened, compared with the conventional one. The electrical resistivity is reduced accordingly, with the result that the power loss and hence the heat generation can be suppressed.

When the movable electrode 7 is at the making position Y1, the electric power continues to be supplied for the load. Therefore, time duration of this state is much longer than that of others. If the movable electrode 7 directly contacts with the load-side lead 9 as in a conventional switch, there is a fear that contacting surfaces of both are melted to adhere to each other. According to the present invention, there does not exist such fear, because an electrical contact between these electrodes is provided via a flexible conductor 22 made of appropriate material for that purpose.

As shown in FIGS. 1 and 2 illustrating basic structures of the present invention, an earthing device can be omitted. Further, the disconnecting position can also be omitted, as already described. Thereby, a vacuum container as well as operating mechanism, and therefore a switchgear as a whole, can be further miniaturized.

Since the movable electrode 7 is coupled with the load-side conductor 9 by the flexible conductor 22, the former can be electrically connected with the latter, and therefore with the cable head 10 in the shortest electric path. As a result, its electric resistivity becomes small and the heat generation within the vacuum container can be suppressed accordingly. Further, since the flexible conductor 22 is used, the free relative movement of the movable electrode 7 with respect to the load-side conductor 9 can be secured, with the electric conductivity therebetween maintained.

Referring to the embodiment described in FIGS. 6 and 7, the insulator 42 is disposed in the direction of stroke of the movable electrode 7. Therefore, an impact force arising when movable electrode 7 impinges on stationary contact 5 and earth side contact 39 can be absorbed so as to be able to press the electrode 7 against earthing contact 39 without bouncing.

Figure 8:
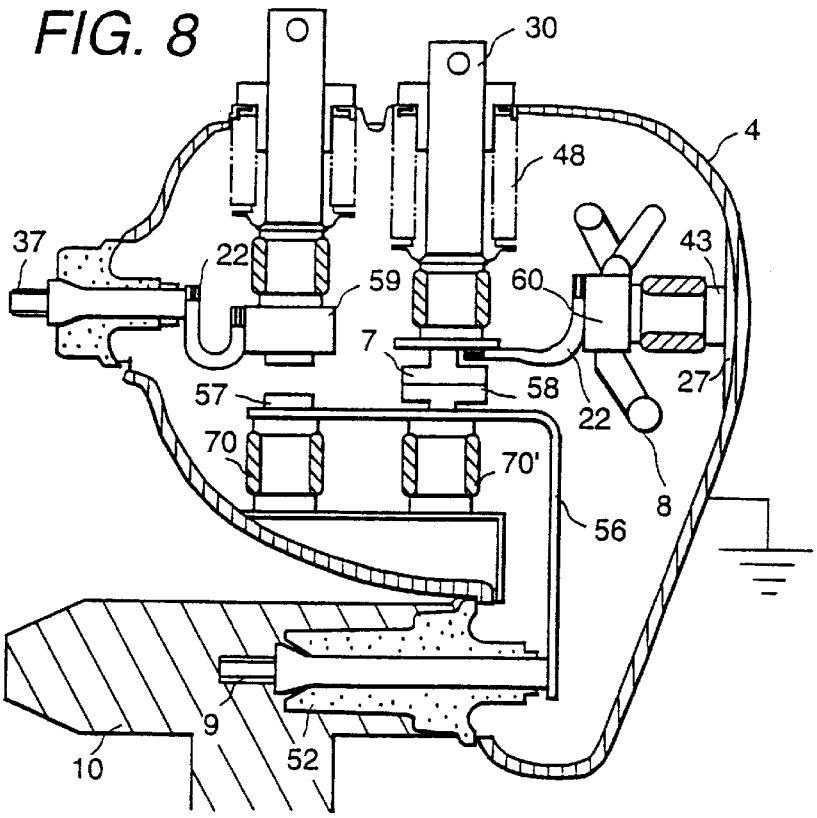
Figure 9:
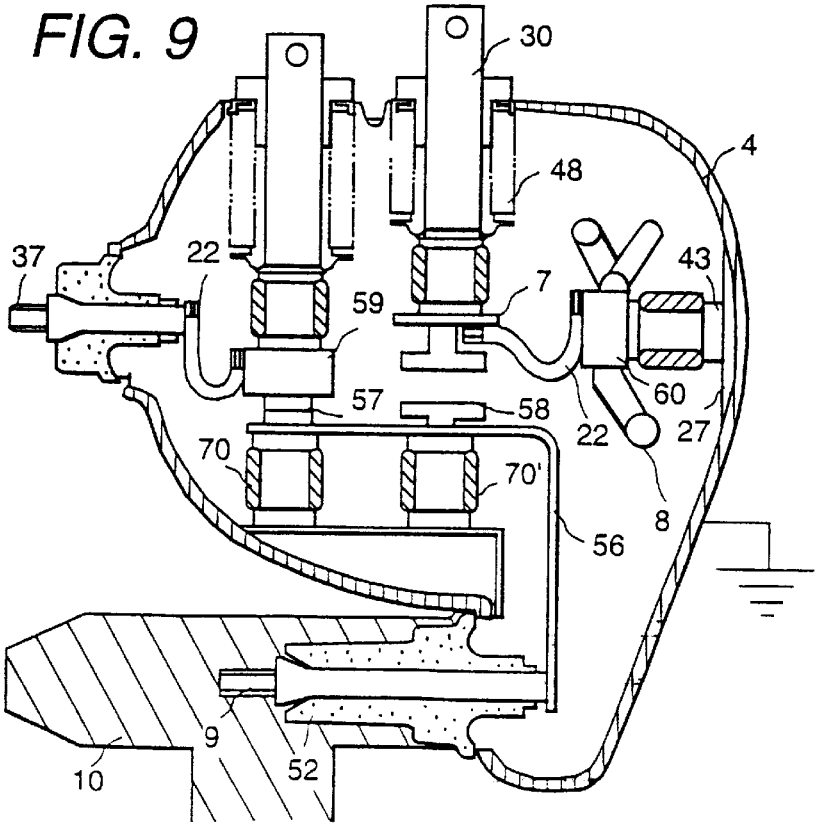

Referring next to FIGS. 8 and 9, description will be made of another embodiment of the present invention, hereinafter.

As shown in the figures, load-side common conductor 56 is installed within the vacuum container 4. The common conductor 56 is further connected to the load-side conductor 9. To the common conductor 56, there are attached stationary contact 57 for earthing and stationary contact 58 for a load circuit. In the vacuum container 4, there are further provided movable contact 59 for earthing and movable contact 7 for the load circuit opposite to respective corresponding stationary contacts.

In such structure as mentioned above, when the movable contact 7 moves downward and contacts with the stationary contact 58, the movable contact 59 for earthing moves upward and is separated from the stationary contact 57, as shown in FIG. 8. This is the contact-making status of the vacuum switch. On the contrary, as shown in FIG. 9, when the movable contact 7 moves upward and is separated from the stationary contact 58, the movable contact 59 for earthing moves downward and contacts with the stationary contact 57. This is the breaking status of the vacuum switch.

That is to say, the making and breaking of the contacts in a vacuum switch and those in an earthing device equipped together with the vacuum switch are done alternately.

The movable contact 59 for earthing is electrically coupled with common earthing terminal 37 by flexible conductor 22. On the opposite side of the earthing contacts 57, 59 with respect to the contacts 7, 58, there is provided terminal 60 corresponding to each phase of three phase internal bus bars 8. The terminal 60 is electrically coupled with the movable contact 7 by the flexible conductor 22. In the embodiments described with reference to FIGS. 8 and 9, insulator 70 or 70' is disposed in the direction of stroke of the earth side movable electrode 59 or the load side movable electrode 7 via an earth side common conductor 37. Therefore, an impact force arising when earth side movable electrode 59 or load side movable electrode 7 impinges on earth side contact 57 or load side contact 58, can be absorbed so as to be able to press earth side contact 57 or load side contact 58 against earth side movable electrode 59 or load side electrode 7 without bouncing.

The switchgear, as mentioned above, according to the present invention can be used for an independent device, such as a circuit breaker, a vacuum circuit breaker, a circuit disconnector, and an earthing switch.

Figure 10:
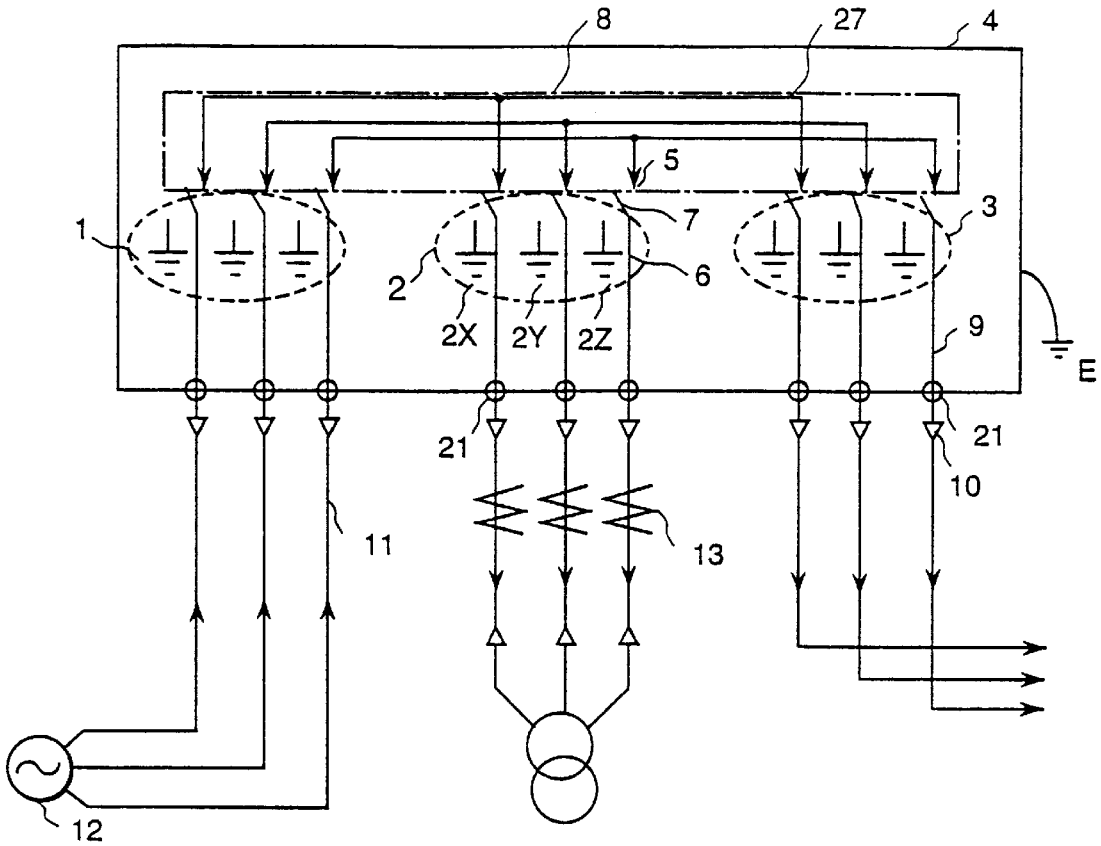
FIG. 10 shows a circuit of a three phase, three circuit switchgear of the present invention.

FIG. 10 shows a circuit arrangement of a three phase, three circuit switchgear, in which switchgears for three circuits are accommodated in one vacuum container. A switchgear for one circuit is composed of three switches for respective phases U, V, W. In the figure, switchgears 1, 2, 3 circled by broken lines, each of which has the same construction, is accommodated and arranged within the vacuum container 4, which is earthed. The circuit switchgear 2 is constructed by collecting phase switchgears 2X, 2Y, 2Z for three phases. The circuit switchgear 1 is coupled with circuit power source 12 through cables 11. The circuit switchgear 2 is coupled with the load through the current transformers 13. The circuit switchgear 3 is coupled with other circuit.

Figure 11:
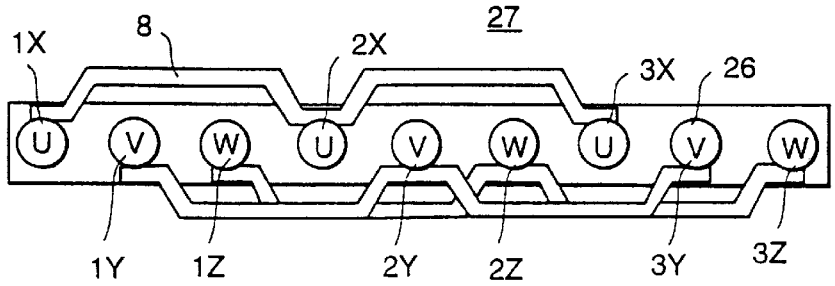
FIG. 11 shows a connecting terminal board of bus bars of the switchgear as shown in FIG. 10.

FIG. 11 shows the construction of junction terminal board 27. When the internal bus bars 8 are allotted to terminals of the board 27, three terminals on the left end side are allotted to the internal bus bars 8 of the switchgear for the first circuit, three terminals in the middle to those for the second circuit, and three terminals on the right end side to those for the third circuit. The bus bar 8 coupling the terminals 1X, 2X, 3X of the first phase is arranged on one side of the terminal board and the bus bars 8 coupling the terminals 1Y, 2Y, 3Y and 1Z, 2Z, 3Z respectively are arranged on the other side of the terminal board so as to overlap each other.

With this arrangement, wiring becomes easy and an error in the wiring can be prevented. Further, the deterioration of the wiring due to heat can be prevented through provision of the distributed arrangement of the internal bus bars.

What is claimed is:

1. A vacuum switch comprising:

an earthed vacuum container, a main part of which is made of conductive material;

a stationary electrode enclosed in the vacuum container in an airtight state;

a movable electrode enclosed in the vacuum container in an airtight state, which is driven by an operating mechanism;

an earthing electrode enclosed in the vacuum container in an airtight state, which is coupled with an earthing conductor;

a first solid insulator, disposed entirely within the vacuum container, for insulating the stationary electrode from the conductive material of the vacuum container;

a second solid insulator, disposed entirely within the vacuum container, for insulating the movable electrode from the conductive material of the vacuum container; and a third solid insulator for insulating the earthing electrode from the conductive material of the vacuum container.

2. The vacuum switch according to claim 1, wherein a contact part of the movable electrode is located between the stationary electrode and the earthing electrode and driven by the operating mechanism to be swung between both the stationary electrode and the earthing electrode.

3. The vacuum switch according to claim 1, wherein a plurality of pairs of the movable electrodes and stationary electrodes are provided in the single vacuum container, each of said pairs consisting of a movable electrode and a stationary electrode.

4. A vacuum switch comprising:

an earthed vacuum container, a main part of which is made of conductive material;

a stationary electrode enclosed in the vacuum container in an airtight state;

a movable electrode enclosed in the vacuum container in an airtight state, which is driven by an operating mechanism;

an earthing electrode enclosed in the vacuum container in an airtight state, which is coupled with an earthing conductor;

a load electrode enclosed in the vacuum container in an airtight state, which is coupled with a load;

a first solid insulator, disposed entirely within the vacuum container, for insulating the stationary electrode from the conductive material of the vacuum container;

a second solid insulator, disposed entirely within the vacuum container, for insulating the movable electrode from the conductive material of the vacuum container;

a third solid insulator for insulating the earthing electrode from the conductive material of the vacuum container; and a fourth solid insulator for insulating the load electrode from the conductive material of the vacuum container.

5. The vacuum switch according to claim 4, wherein a contact part of the movable electrode is located between the stationary electrode and the earthing electrode and driven by the operating mechanism to be swung between both the stationary electrode and the earthing electrode.

6. The vacuum switch according to claim 4, wherein a contact part of the movable electrode is electrically coupled with the load electrode by a flexible conductor.

7. The vacuum switch according to claim 4, wherein a plurality of pairs of movable electrodes and stationary electrodes are provided in the vacuum container, each of said pairs consisting of a movable electrode and a stationary electrode.

8. The vacuum switch according to claim 4, wherein a contact part of the movable electrode is driven by the operating mechanism such that the contact part can stop at least at a position Y2, or at positions Y2 and Y3 between the stationary electrode and the earthing electrode, wherein the position Y2 is the position at which the contact part is maintained until an arc generated by breaking operation of the movable electrode extinguishes, and the position Y3 is the position at which a sufficient insulation between the movable electrode and the stationary electrode as well as the earthing electrode is ensured to be maintained.

9. The vacuum switch according to claim 4, wherein the second solid insulator also serves for preventing current from flowing from the movable electrode to the operating mechanism.

10. The vacuum switch according to claim 4, wherein contact surfaces of the stationary electrode and the earthing electrode are inclined in a direction of stroke of the movable electrode.

11. The vacuum switch according to claim 4, wherein three phase internal bus bars and a junction terminal board are disposed entirely within the vacuum container, and one of three phase internal bus bars is arranged on one side of the junction terminal board and a remaining two bus bars are arranged on the other side of the junction terminal board in a lapping relation.

12. A vacuum switchgear comprising:

a vacuum switch having an earthed vacuum container, a main part of which is made of conductive material, a stationary electrode enclosed in the vacuum container in an airtight state, a movable electrode enclosed in the vacuum container in an airtight state, an earthing electrode enclosed in the vacuum container in an airtight state, which is coupled with an earthing conductor, a load electrode enclosed in the vacuum container in an airtight state, which is coupled with a load, a first solid insulator, disposed entirely within the vacuum container, for insulating the stationary electrode from the conductive material of the vacuum container, a second solid insulator, disposed entirely within the vacuum container, for insulating the movable electrode from the conductive material of the vacuum container, a third solid insulator for insulating the earthing electrode from the conductive material of the vacuum container and a fourth solid insulator for insulating the load electrode from the conductive material of the vacuum container;

an operating mechanism for driving the movable electrode;

an operating compartment for accommodating the operating mechanism; and a metallic cubicle for accommodating the vacuum switch and the operating compartment, the metallic cubicle being earthed.

13. The vacuum switchgear according to claim 12, wherein a contact part of the movable electrode is located between the stationary electrode and the earthing electrode and is driven by the operating mechanism to move stepwise between both the stationary electrode and the earthing electrode.

14. The vacuum switchgear according to claim 12, wherein a contact part of the movable electrode is electrically coupled with the load electrode by a flexible conductor.

15. The vacuum switchgear according to claim 12, wherein a contact part of the movable electrode is driven by the operating mechanism such that the contact part can stop at least at a position Y2, or at positions Y2 and Y3 between the stationary electrode and the earthing electrode, wherein the position Y2 is the position at which the contact part is maintained until an arc generated by breaking operation of the movable electrode extinguishes, and the position Y3 is the position at which a sufficient insulation between the movable electrode and the stationary electrode as well as the earthing electrode is ensured to be maintained.

16. The vacuum switchgear according to claim 12, wherein when the movable electrode is in the middle position between the stationary electrode and the earthing electrode, the volume of the vacuum container on the side of the stationary electrode is larger than the volume on the side of the earthing electrode.

17. The vacuum switchgear according to claim 12, wherein a lead conductor of the earthing conductor is coupled with the vacuum container.

18. The vacuum switchgear according to claim 12, wherein the second solid insulator also serves for preventing current from flowing from the movable electrode to the operating mechanism.

19. The vacuum switchgear according to claim 12, wherein the stationary electrode and the earthing electrode each have an inclined contact surface.

20. The vacuum switchgear according to claim 12, wherein three phase internal bus bars and a junction terminal board are disposed entirely within the vacuum container, and one of the three phase internal bus bars is arranged on one side of the junction terminal board and a remaining two bus bars are arranged on the other side of the junction terminal board in a lapping relation.

21. A vacuum switchgear comprising:

a vacuum switch having an earthed vacuum container, a main part of which is made of conductive material; a stationary electrode enclosed in the vacuum container in an airtight state; a movable electrode enclosed in the vacuum container in an airtight state; an earthing electrode enclosed in the vacuum container in an airtight state, which is coupled with an earthing conductor; a load electrode enclosed in the vacuum container in an airtight state, which is coupled with a load; a first solid insulator, disposed entirely within the vacuum container, for insulating the stationary electrode from the conductive material of the vacuum container; a second solid insulator, disposed entirely within the vacuum container, for insulating the movable electrode from the conductive material of the vacuum container; a third solid insulator for insulating the earthing electrode from the conductive material of the vacuum container and a fourth solid insulator for insulating the load electrode from the conductive material of the vacuum container;

an operating mechanism for driving the movable electrode;

an operating compartment for accommodating the operating mechanism;

a conductor compartment for accommodating conductors connected to the load; and a metallic cubicle for accommodating the vacuum switch, the operating compartment and the conductor compartment, the metallic cubicle being earthed.

22. The vacuum switchgear according to claim 21, wherein a contact part of the movable electrode is located between the stationary electrode and the earthing electrode and driven by the operating mechanism to swing between both the stationary electrode and the earthing electrode.

23. The vacuum switchgear according to claim 21, wherein a contact part of the movable electrode is electrically coupled with the load electrode by a flexible conductor.

24. The vacuum switchgear according to claim 21, wherein a contact part of the movable electrode is driven by the operating mechanism such that the contact part can stop at least at a position Y2, or at positions Y2 and Y3 between the stationary electrode and the earthing electrode, wherein the position Y2 is the position at which the contact part is maintained until an arc generated by breaking operation of the movable electrode extinguishes, and the position Y3 is the position at which a sufficient insulation between the movable electrode and the stationary electrode as well as the earthing electrode is ensured to be maintained.

25. The vacuum switchgear according to claim 21, wherein when the movable electrode is in the middle position between the stationary electrode and the earthing electrode, the volume of the vacuum container on the side of the stationary electrode is larger than the volume on the side of the earthing electrode.

26. The vacuum switchgear according to claim 21, wherein a lead conductor of the earthing conductor is coupled with the vacuum container.

27. The vacuum switchgear according to claim 21, wherein the second solid insulator also serves for preventing current from flowing from the movable electrode to the operating mechanism.

28. The vacuum switchgear according to claim 21, wherein the stationary electrode and the earthing electrode each have an inclined contact surface.

29. The vacuum switchgear according to claim 21, wherein three phase internal bus bars and a junction board are disposed entirely within the vacuum container, and one of the three phase internal bus bars is arranged on one side of the junction terminal board and a remaining two bus bars are arranged on the other side of the junction terminal board in a lapping relation.

30. A vacuum switch comprising:

an earthed vacuum container, a main part of which is made of conductive material;

a stationary electrode enclosed in the vacuum container in an airtight state;

a load electrode enclosed in the vacuum container in an airtight state, which is coupled with a load conductor;

a first movable electrode enclosed in the vacuum container in an airtight state, which is coupled with the stationary electrode, for making contact with and separation from the load electrode;

an earthing electrode enclosed in the vacuum container in an airtight state, which is coupled with an earthing conductor;

a second movable electrode enclosed in the vacuum container in an airtight state, which is coupled with the earthing electrode, for making contact with and separation from the load electrode, wherein the contact with and separation of the first movable electrode and the second movable electrode from the load conductor are done asynchronously with each other;

a first solid insulator, disposed entirely within the vacuum container, for insulating the stationary electrode from the conductive material of the vacuum container;

a second solid insulator, disposed entirely within the vacuum container, for insulating the first and the second movable electrodes from the conductive material of the vacuum container;

a third solid insulator for insulating the earthing electrode from the conductive material of the vacuum container; and a fourth solid insulator for insulating the load electrode from the conductive material of the vacuum container.

31. A vacuum switchgear provided with a vacuum switch according to claim 4.

32. A vacuum switchgear provided with a vacuum switch according to claim 30.

33. A vacuum switch comprising:

an earthed vacuum container, a main part of which is made of conductive material;

a stationary electrode enclosed in the vacuum container in an airtight state;

a movable electrode enclosed in the vacuum container in an airtight state, which is driven by an operating mechanism;

a load electrode enclosed in the vacuum container in an airtight state, which is coupled with a load;

a first solid insulator, disposed entirely within the vacuum container, for insulating the stationary electrode from the conductive material of the vacuum container;

a second solid insulator, disposed entirely within the vacuum container, for insulating the movable electrode from the conductive material of the vacuum container;

another solid insulator for insulating the load electrode from the conductive material of the vacuum container; and wherein the movable electrode is electrically coupled with the load electrode by a flexible conductor.

* * * * *